US008925258B1

(12) United States Patent
Header et al.

(10) Patent No.: US 8,925,258 B1
(45) Date of Patent: Jan. 6, 2015

(54) WALL AND DOOR PANEL ADJUSTMENT DEVICE

(71) Applicant: Gregory Header, Pine Grove, PA (US)

(72) Inventors: Gregory Header, Richland, PA (US); Ari Figueroa, Middletown, PA (US)

(73) Assignee: Gregory Header, Pine Grove, PA (US)

( * ) Notice: Subject to any disclaimer, the term of this patent is extended or adjusted under 35 U.S.C. 154(b) by 0 days.

(21) Appl. No.: 14/165,204

(22) Filed: Jan. 27, 2014

(51) Int. Cl.
*E04B 2/82* (2006.01)
*E05D 15/00* (2006.01)
*E06B 1/60* (2006.01)

(52) U.S. Cl.
CPC ..... *E05D 15/00* (2013.01); *E06B 1/6076* (2013.01); *E04B 2/828* (2013.01)
USPC ..... 52/126.4; 52/767; 16/90; 16/94 R

(58) Field of Classification Search
CPC . E05D 15/16; E05D 15/0634; E05D 15/0669; E06B 3/5864; E06B 3/5857; E06B 3/5481; E05Y 2099/131; E05Y 2099/132; E05Y 2099/142
USPC ..... 52/126.4, 126.3, 126.1, 126.7, 481.2, 52/217, 241, 764, 766, 767, 208, 204.53, 52/204.591, 204.597, 204.599, 204.64, 52/800.1, 800.11, 800.12, 800.13, 800.16, 52/800.17, 800.18; 49/410, 409, 425, 417, 49/418, 399, 400; 16/90, 91, 93 R, 94 R, 16/252, 255, 284, 382
See application file for complete search history.

(56) References Cited

U.S. PATENT DOCUMENTS

| | | | | | |
|---|---|---|---|---|---|
| 1,900,077 | A | * | 3/1933 | Riffle | 292/341.11 |
| 2,524,961 | A | * | 10/1950 | Cramer, Jr. | 254/104 |
| 3,325,942 | A | * | 6/1967 | Bejarano | 49/381 |
| 3,390,862 | A | * | 7/1968 | Schrepfer | 254/104 |
| 3,404,501 | A | * | 10/1968 | Von Wedel | 52/204.64 |
| 3,566,559 | A | * | 3/1971 | Dickson | 52/126.4 |
| 3,696,569 | A | * | 10/1972 | Didry | 52/126.4 |
| 3,714,738 | A | * | 2/1973 | Koslow et al. | 49/404 |
| 4,104,830 | A | * | 8/1978 | Eagle | 49/468 |
| 4,156,325 | A | * | 5/1979 | McMullen et al. | 49/468 |
| 4,655,025 | A | * | 4/1987 | Marinoni | 52/771 |
| 4,689,853 | A | * | 9/1987 | Marinoni | 16/382 |

(Continued)

FOREIGN PATENT DOCUMENTS

| | | | |
|---|---|---|---|
| AU | 2009201934 | A1 | 5/2009 |
| CA | 2117995 | A1 | 10/1994 |

(Continued)

*Primary Examiner* — James Ference
(74) *Attorney, Agent, or Firm* — Stone Creek Services LLC; Alan M Flum

(57) ABSTRACT

A device for adjusting wall or door panels without the need to remove or disassembly the panels from their panel frames. The device can adjust the distance of the in-fill panel from a stationary frame or trolley track. Multiple devices can be utilized and adjusted independently allowing for angle adjustment of the panel. The device includes an in-fill attachment a threaded fastener, two angled adjustment blocks, and a block keeper. The in-fill attachment includes inset angled pockets, a wedge like portion, and an in-fill receiving portion. As the threaded fastener is turned, the angled sides of the two angled adjustment blocks slide along the angle pockets and move the in-fill attachment either toward or away from the panel frame thereby also moving the panel toward or away from the panel frame.

8 Claims, 11 Drawing Sheets

(56) References Cited

U.S. PATENT DOCUMENTS

| | | | | |
|---|---|---|---|---|
| 4,805,358 | A * | 2/1989 | Fork | 52/126.2 |
| 5,069,010 | A * | 12/1991 | Trainor et al. | 52/127.8 |
| 5,444,958 | A * | 8/1995 | Lu | 52/775 |
| 5,860,189 | A * | 1/1999 | An | 16/91 |
| 5,867,869 | A * | 2/1999 | Garrett et al. | 16/252 |
| 6,021,547 | A * | 2/2000 | Stagoll | 16/105 |
| 6,058,665 | A * | 5/2000 | Halvorson et al. | 52/205 |
| 6,079,169 | A * | 6/2000 | Ashworth | 52/217 |
| 6,161,255 | A * | 12/2000 | Garrett | 16/284 |
| 6,434,905 | B1 * | 8/2002 | Sprague | 52/474 |
| 6,481,055 | B2 * | 11/2002 | Cheng | 16/252 |
| 6,519,811 | B1 * | 2/2003 | Cheng | 16/252 |
| 6,526,627 | B2 * | 3/2003 | Chiang | 16/284 |
| 6,912,818 | B2 * | 7/2005 | Sprague | 52/208 |
| 6,925,685 | B2 * | 8/2005 | Chen | 16/332 |
| 7,305,796 | B2 * | 12/2007 | Chiang | 49/388 |
| 7,380,378 | B2 * | 6/2008 | Clifford et al. | 52/204.72 |
| 7,584,588 | B2 * | 9/2009 | Kim | 52/800.14 |
| 7,594,302 | B2 * | 9/2009 | Balenzano | 16/252 |
| 7,712,258 | B2 * | 5/2010 | Ewing et al. | 49/410 |
| 7,891,052 | B2 * | 2/2011 | Haab et al. | 16/98 |
| 7,963,077 | B2 * | 6/2011 | Lin | 52/204.597 |
| 2002/0100234 | A1 * | 8/2002 | Sprague | 52/208 |
| 2006/0070318 | A1 * | 4/2006 | Chen et al. | 52/204.65 |
| 2008/0092464 | A1 * | 4/2008 | Haab et al. | 52/204.7 |
| 2008/0202047 | A1 * | 8/2008 | Flannery | 52/205 |
| 2010/0269291 | A1 * | 10/2010 | Haab et al. | 16/91 |
| 2013/0111702 | A1 * | 5/2013 | Ewing | 16/91 |
| 2013/0219797 | A1 * | 8/2013 | Bonomie et al. | 49/399 |

FOREIGN PATENT DOCUMENTS

| | | | |
|---|---|---|---|
| DE | 9216371 | U1 | 5/1993 |
| DE | 202007014690 | U1 | 4/2009 |
| EP | 649964 | A1 | 10/1994 |
| EP | 2369114 | A1 | 9/2011 |
| FR | 2446911 | A3 | 8/1980 |
| JP | 2000291321 | A | 10/2000 |
| JP | 2001336340 | A | 12/2001 |
| KR | 20020011199 | A | 2/2002 |
| KR | 101022816 | B1 | 3/2011 |

* cited by examiner

WALL AND DOOR PANEL ADJUSTMENT DEVICE

BACKGROUND

The present disclosure relates to a device for adjusting a wall or door panels relative to their mounting frame.

Typically, door and wall in-fill panels can have fabrication and manufacturing tolerances. These tolerances can cause the in-fill panels to be too large, too small, or have offsets in their specified shape. Because of this, the in-fill panels may not fit into the provided openings or can cause hardware, such as trollies or the sliding mechanisms, to bind and not operate properly.

One solution is to adjust the in-fill panel to their panel frame at the job site. For example, adjustment can be accomplished by using metal shims between the panel frame and in-fill panel to properly fit the in-fill panel relative to the panel frame. While adjusting the frame assembly at the job site can help to compensate for fabrication tolerances, it is not convenient and requires that the adjustments be made before the panel is assembled and installed. In addition, once the panel assembly is installed, making additional adjustments generally requires the panel frame and in-fill panel to be removed from their installation opening and be partially dissembled. This can be potentially time consuming and labor intensive.

SUMMARY

Disclosed is a wall/door panel adjustment device that attempts to overcome the challenges described in the Background section. This device allows the in-fill panel be adjusted relative to the panel frame and/or head and sill, after assembly and after installation, without removal of the panel frame assembly from the installation opening and without disassembly or removal of the in-fill panel from the panel frame. In one aspect, the wall/door panel adjustment device includes an in-fill attachment, a pair of angled adjustment blocks, a block keeper, a threaded adjustment fastener, an in-fill fastener, and optionally, one or more springs. The in-fill attachment includes an in-fill receiving portion, a wedge-like portion, and angled pockets. The in-fill receiving portion includes a hollow interior portion with two substantially parallel downward projected sides for surrounding the top edge of a door or wall in-fill. The in-fill fastener secures the in-fill to the in-fill receiving portion of the in-fill attachment. The apex of the wedge-like portion faces the top of the in-fill receiving portion. The angled pockets are inset with respect to the outer surfaces of the in-fill receiving portion and the wedge-like portion. The wedge-like portion and the top edge of the exterior surface of the in-fill receiving portion define the boundaries of the angled pockets.

The in-fill panel moves relative to the panel frame and/or head and sill by tightening or loosening the threaded adjustment fastener. When the threaded adjustment fastener is tightened, the angled adjustment blocks are pulled closer together simultaneously along the angled sides of the wedge-like portion which moves the in-fill closer to the panel frame. When the threaded adjustment fastener is loosened, the angled adjustment blocks move farther apart along the angled sides of the wedge-like portion which moves the in-fill farther from the panel frame and/or head and sill. The action can be accomplished by either gravity or by spring tension.

The block keeper can be secured to a slot in the top of the panel frame by screws engaged with a threaded aperture within the slot. A shelf portion in the interior of the panel frame supports the bottom of the angled adjustment blocks. A cutout in the interior slot as well as a shelf portion allows the in-fill receiving portion to move toward and away from the frame. Springs between the block keeper and the top of the in-fill attachment create spring tension between the two elements and aid in adjustment of in-fill receiving portion.

This Summary has introduced a selection of concepts in simplified form that are described with additional detail in the Description in order to aid in the understanding of this disclosure. The Summary is not intended to identify essential features or limit the scope of the claimed subject matter.

DRAWINGS

DESCRIPTION

Figure 1:
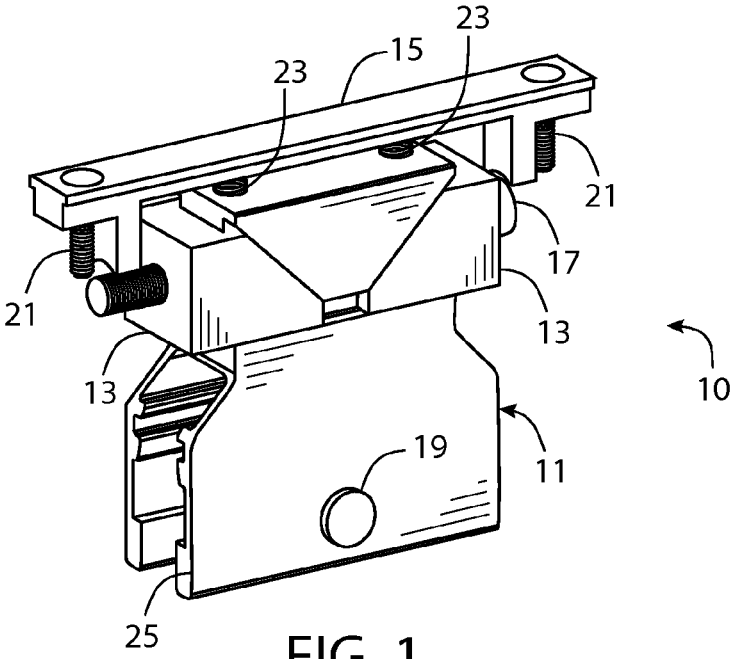
FIG. 1 illustrates a top, front, and left side perspective view of a wall and door panel adjustment device.

The terms "up", "down", "left", "right", "horizontal", and "vertical" are used throughout this disclosure, unless otherwise indicated, as relative terms particular to the drawing being described. Their purpose is to aid in the understanding of the drawings and it should be understood by the reader that these terms are not meant to limit the claims to any particular direction or orientation. For the purpose of this disclosure in-fill can be any material typically used for door or wall panels. For example, the in-fill can be fabricated from wood, glass, aluminum, steel, acrylic, or polycarbonate, quartz, or a composite of several materials.

Figure 2:
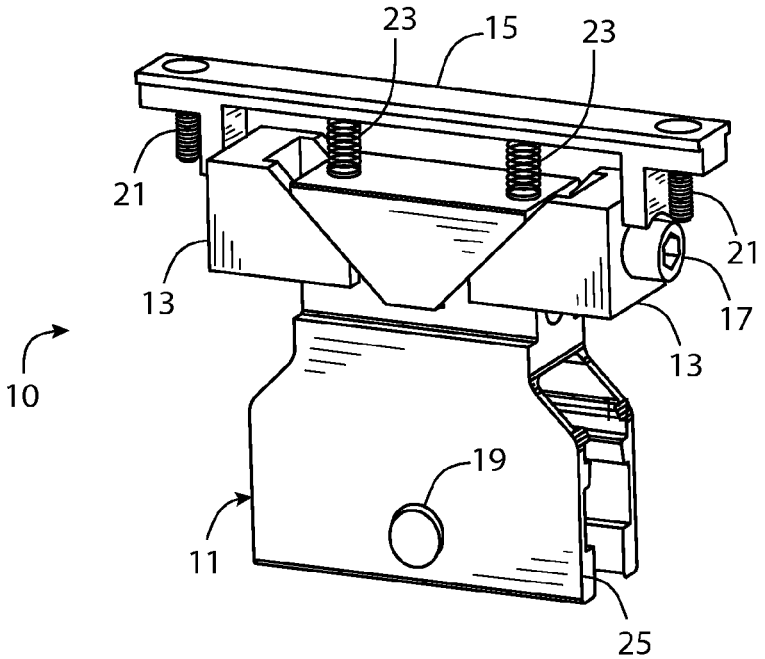
FIG. 2 illustrates a top, front, and right side perspective view of the device of FIG. 1.
Figure 3:
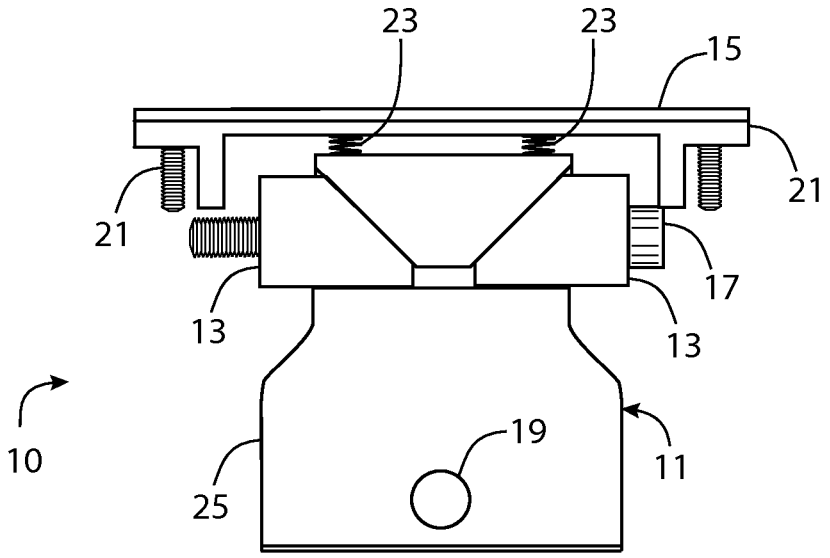
FIG. 3 illustrates a front elevation view of the device of FIG. 1.
Figure 4:
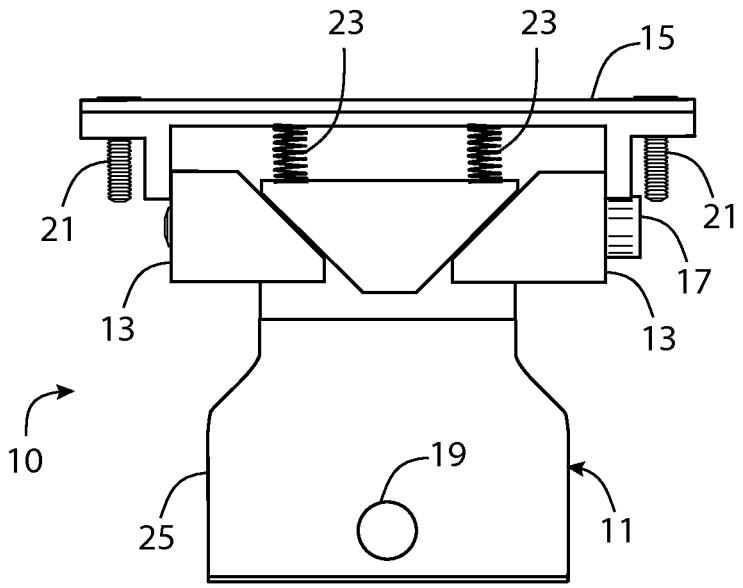
FIG. 4 illustrates a front elevation view of the device of FIG. 1 adjusted in an alternative position from FIG. 3.
Figure 5:
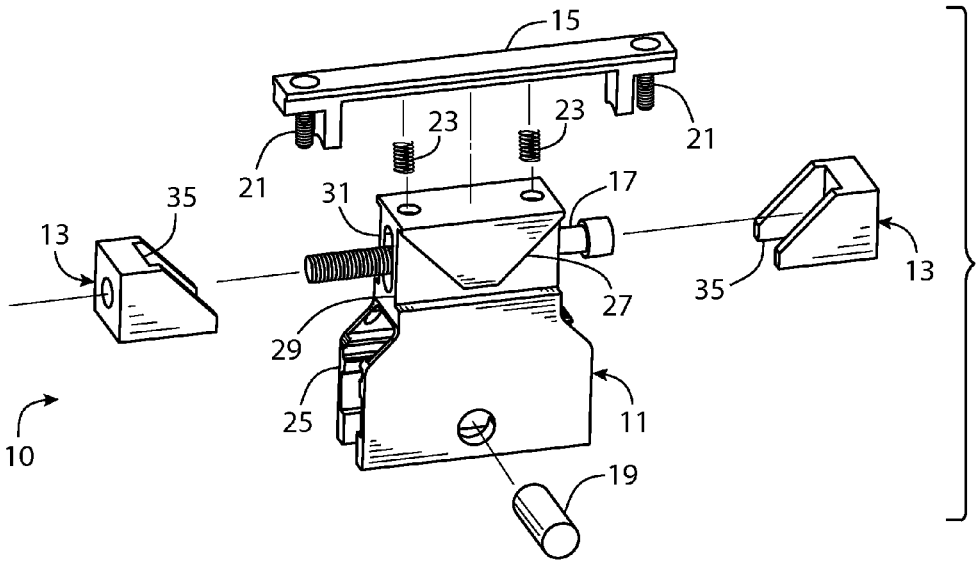
FIG. 5 illustrates a top, front and left side exploded perspective view of the device of FIG. 1.

The following description is made with reference to the figures, where like numerals refer to like elements throughout the several views, FIGS. 1-6 illustrate a wall/door panel adjustment device 10 for adjusting wall and door panels relative to their mounting or panel frames and/or the head and sill portion of the building frame assembly. FIG. 1 illustrates a top, front, and left side perspective view and FIG. 2 a top, front, and right side perspective view of the wall/door panel adjustment device 10. FIG. 3 illustrates a front elevation view of the wall/door panel adjustment device 10. FIG. 4 illustrates a front elevation view of the wall/door panel adjustment device 10 adjusted in an alternative position from FIG. 3. FIG. 5 illustrates a top, front and left side exploded perspective view, and FIG. 6 a front exploded elevation view of the wall/door panel adjustment device 10.

Referring to FIGS. 1-6, the wall/door panel adjustment device 10 includes an in-fill attachment 11, a pair of angled adjustment blocks 13, a block keeper 15, a threaded adjustment fastener 17, an in-fill fastener 19, threaded fasteners 21, and optionally, one or more springs 23.

Figure 6:
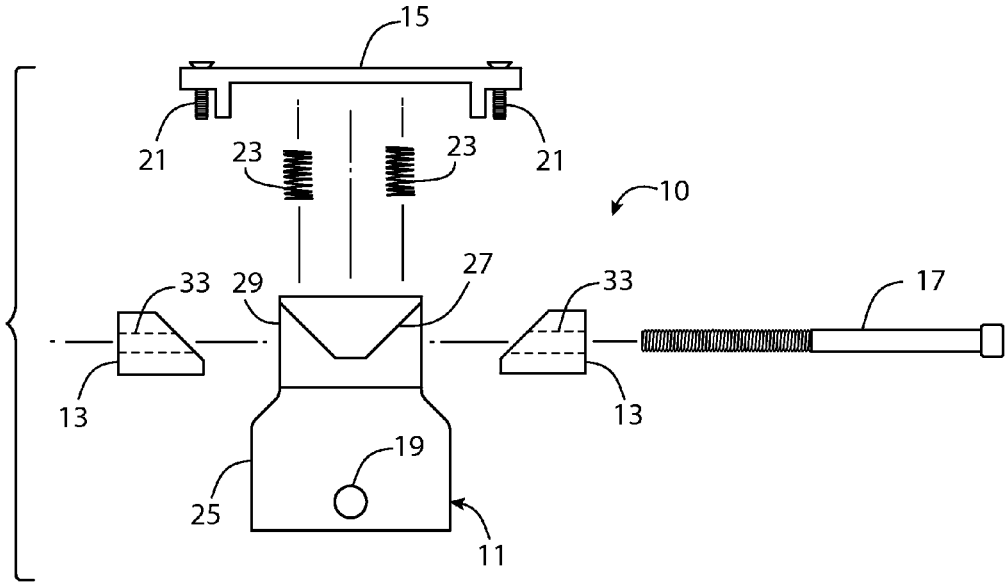
FIG. 6 illustrates a front exploded elevation view of the device of FIG. 1.

Referring to FIGS. 5-6, the in-fill attachment 11 includes an in-fill receiving portion 25, a wedge-like portion 27, and angled pockets 29. The in-fill receiving portion 25 is illustrated having a hollow interior portion with two substantially parallel downward projected sides for surrounding the top edge of a door or wall in-fill. The in-fill fastener 19 secures the in-fill to the in-fill receiving portion 25 of the in-fill attachment 11. The in-fill fastener 19 illustrated is a pin, however, it can be any fastener appropriate for the in-fill material used. For example, if the in-fill material is glass, then the in-fill fastener 19 could be an architectural glass system bolt assembly or a rigid combination fastener designed specifically for glass.

Referring to FIG. 5, the apex of the wedge-like portion 27 faces the top of the in-fill receiving portion 25. The angled pockets 29 are inset with respect to the outer surfaces of the in-fill receiving portion 25 and the wedge-like portion 27. The wedge-like portion 27 and the top edge of the exterior surface of the in-fill receiving portion 25 define the boundaries of the angled pockets 29. The in-fill receiving portion 25, wedge-like portion 27, and angled pockets 29 are typically an integrally machined or otherwise integrally formed portion of the in-fill attachment 11. For example, the in-fill attachment 11 can be extruded and the top edge of the exterior surface of the in-fill receiving portion 25, the bottom edge of the wedge-like portion 27, and the angled pockets 29 can be formed by machining the angled pockets 29 inset. Alternatively, the in-fill attachment 11 can be cast with the top edge of the exterior surface of the in-fill receiving portion 25, the bottom edge of the wedge-like portion 27, and the angled pockets 29 forming integrally cast shapes. Alternatively, the wedge-like portion 27 can be a separately formed attachment that can be screwed, riveted, or otherwise secured to the in-fill attachment 11.

The angled adjustment blocks 13 each include a side that makes the approximately the same angle as the angled side of the wedge-like portion 27. Each angled adjustment block 13 has a hollow interior 35. The width of the hollow interior 35 of the angled adjustment blocks 13 are sized approximately the same as the width of the angled pockets 29 allowing the angled adjustment blocks 13 to slide along their respective side of the wedge-like portion 27. Slotted apertures 31 in the angled pockets allow the threaded adjustment fastener 17 to move toward or away from the top of the in-fill attachment 11.

Referring to FIG. 6, the angled adjustment blocks 13 include an aperture 33. The apertures 33 are sized and shaped to receive and pass-through a portion of the body of the threaded adjustment fastener 17. The apertures 33 can each be threaded to receive and secure the threaded adjustment fastener 17. Optionally, the aperture 33 within the angled adjustment block 13 that seats the head of the threaded adjustment fastener 17 can be non-threaded.

Figure 7:
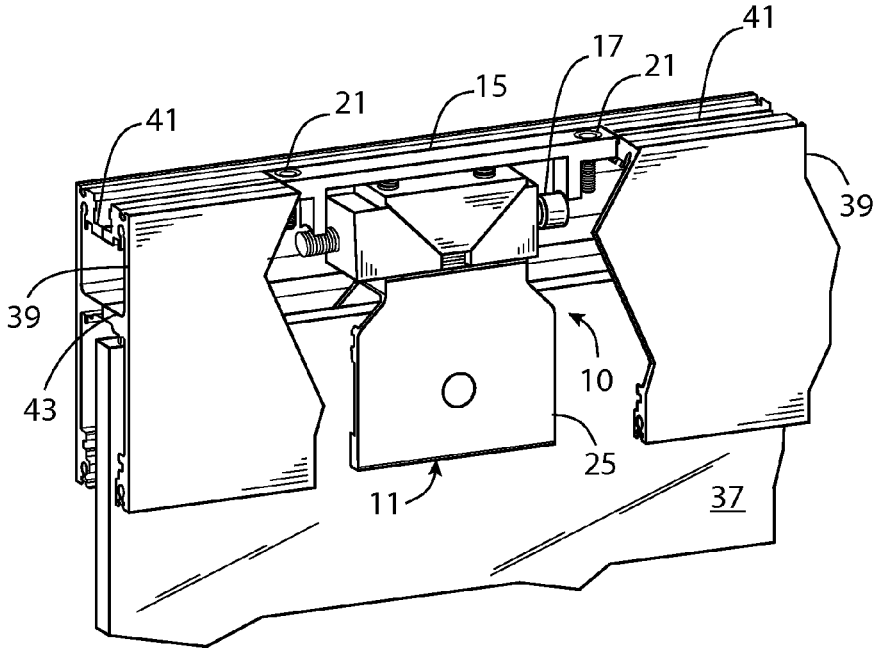
FIG. 7 illustrates a top, front, and left side perspective view, in partial cutaway, a portion of an in-fill panel and panel frame assembled with the mounting device of FIG. 1 with the mounting device adjusting the in-fill panel in a first position.
Figure 8:
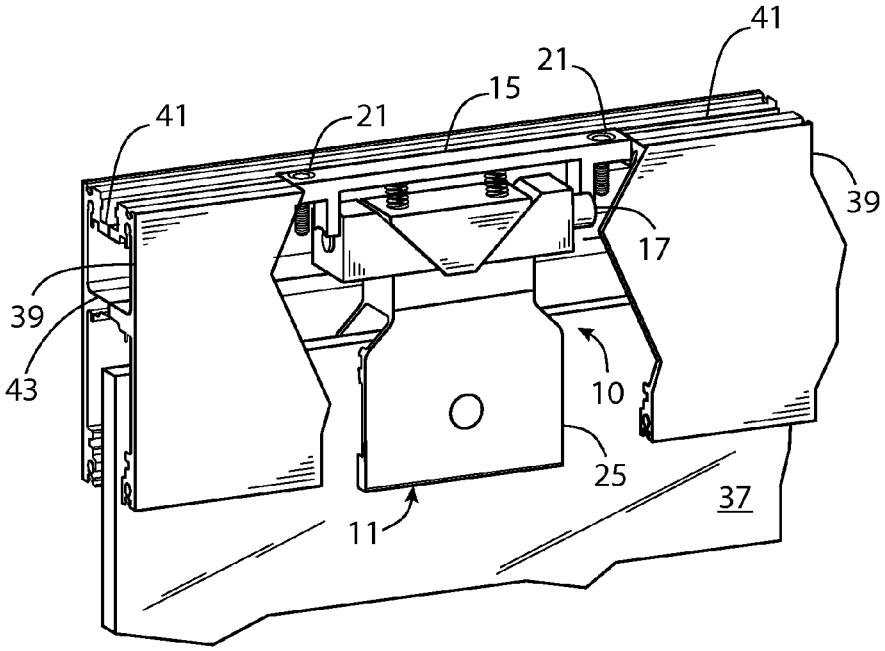
FIG. 8 illustrates the assembly portion of FIG. 7, in partial cutaway, with the mounting device adjusting the in-fill panel in a second position.
Figure 9:
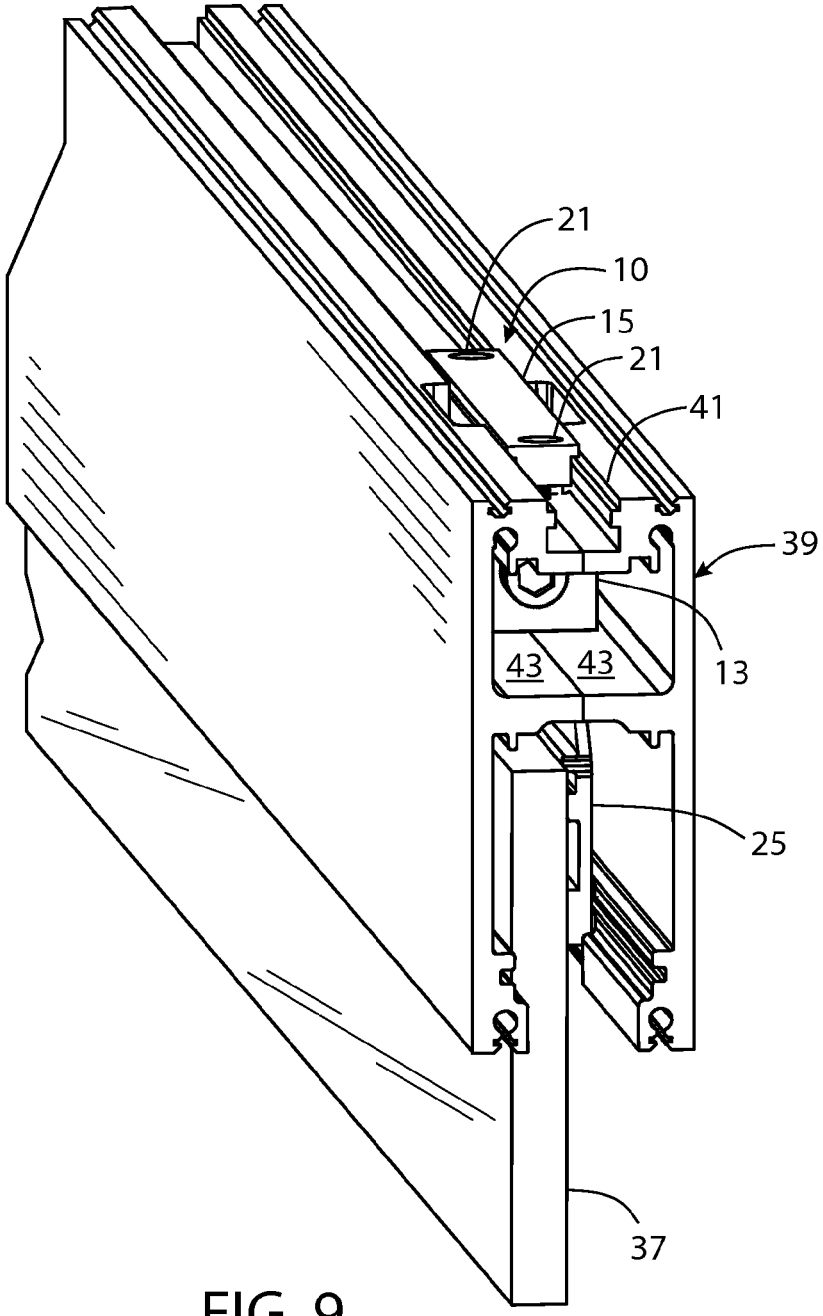
FIG. 9 illustrates in top and right side perspective view, portions of the in-fill panel and the in-fill frame assembled with the door panel adjustment device.
Figure 10:
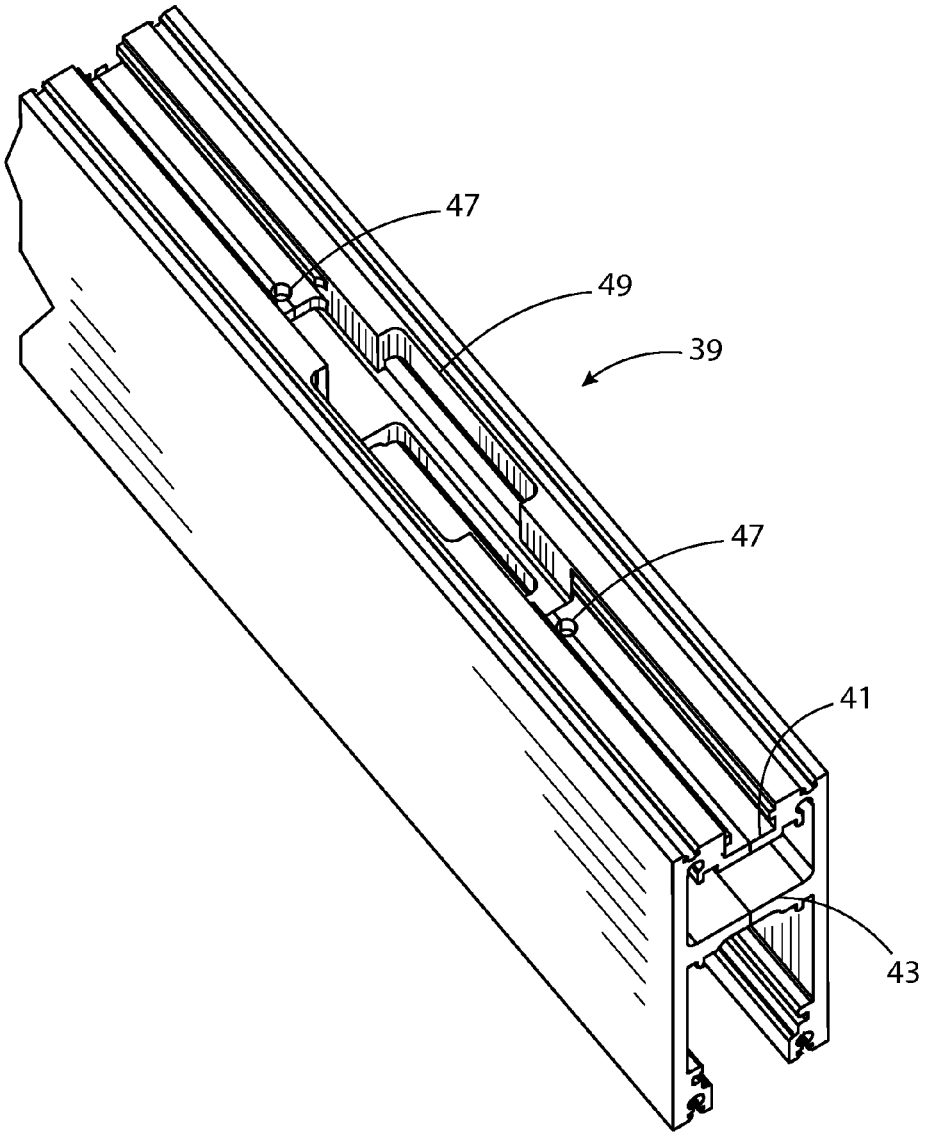
FIG. 10 illustrates in top and right side perspective view, a portion of the in-fill frame by itself.

FIG. 7 illustrates a top, front, and left side perspective view, in partial cutaway, a portion of an in-fill panel 37 and panel frame 39 assembled with wall/door panel adjustment device 10 with the threaded adjustment fastener 17 adjusting the in-fill panel 37 toward the of the top of the panel frame 39. FIG. 8 illustrates the assembly of FIG. 7, with wall/door panel adjustment device 10 with the threaded adjustment fastener adjusting the in-fill panel 37 away from the top of the panel frame 39. In FIGS. 7-8 the front half of the top section of the panel frame 39 is illustrated cutaway to expose the in-fill attachment 11 relative to the in-fill panel 37 and to the back half of the panel frame 39. FIG. 9 illustrates in top and right side perspective view, portions of the in-fill panel 37 and the panel frame 39 assembled with the wall/door panel adjustment device 10. FIG. 10 illustrates in top and right side perspective view, a portion of the panel frame 39 by itself.

Referring to FIGS. 7-9, the block keeper 15 is held captive within the slot 41 that is along the top length of the panel frame 39. Shelf portions 43 perpendicularly and horizontally inward from each half of the panel frame 39 forming a shelf for the angled adjustment blocks 13. The block keeper 15 includes threaded fasteners 21, such as screws or bolts that are used to secure the block keeper 15 to threaded apertures in the slot 41. The threaded apertures 47 are shown in FIG. 10. In FIG. 10, cutouts 49 extend through the slot 41 and the shelf portions 43 of the panel frame 39. In FIG. 9, this keeps the angled adjustment blocks 13 captive within the shelf portion 43 while allowing the in-fill receiving portion 25 to move freely toward and away from the top of the panel frame 39.

Referring to FIGS. 1-4, 7, and 8, the position of the in-fill receiving portion 25 of the in-fill attachment, relatively to the bottom edge of the angled adjustment blocks 13 is adjusted by tightening or loosening the threaded adjustment fastener 17. In FIGS. 1, 3, and 7, the threaded adjustment fastener 17 is tightened, which pulls the angled adjustment blocks 13 closer together horizontality along the angled sides of the wedge-like portion 27. In FIGS. 1, 3, and 7, the result of tightening the threaded adjustment fastener 17 is to move the in-fill panel 37 of FIG. 7 closer to the top of the panel frame 39, also of FIG. 7. In FIGS. 2, 4, and 8, the threaded adjustment fastener 17 is loosened which, pushes the angled adjustment blocks farther apart and upward along the angled sides of the wedge-like portion 27. In FIG. 8, the result of loosening the threaded adjustment fastener 17 is to move the in-fill panel 37 away from the top of the panel frame 39. The springs 23, which are positioned between the top of the in-fill attachment and the bottom of the block keeper 15, provide additional force or compression which aids in adjusting the wall/door panel adjustment device 10.

Figure 11:
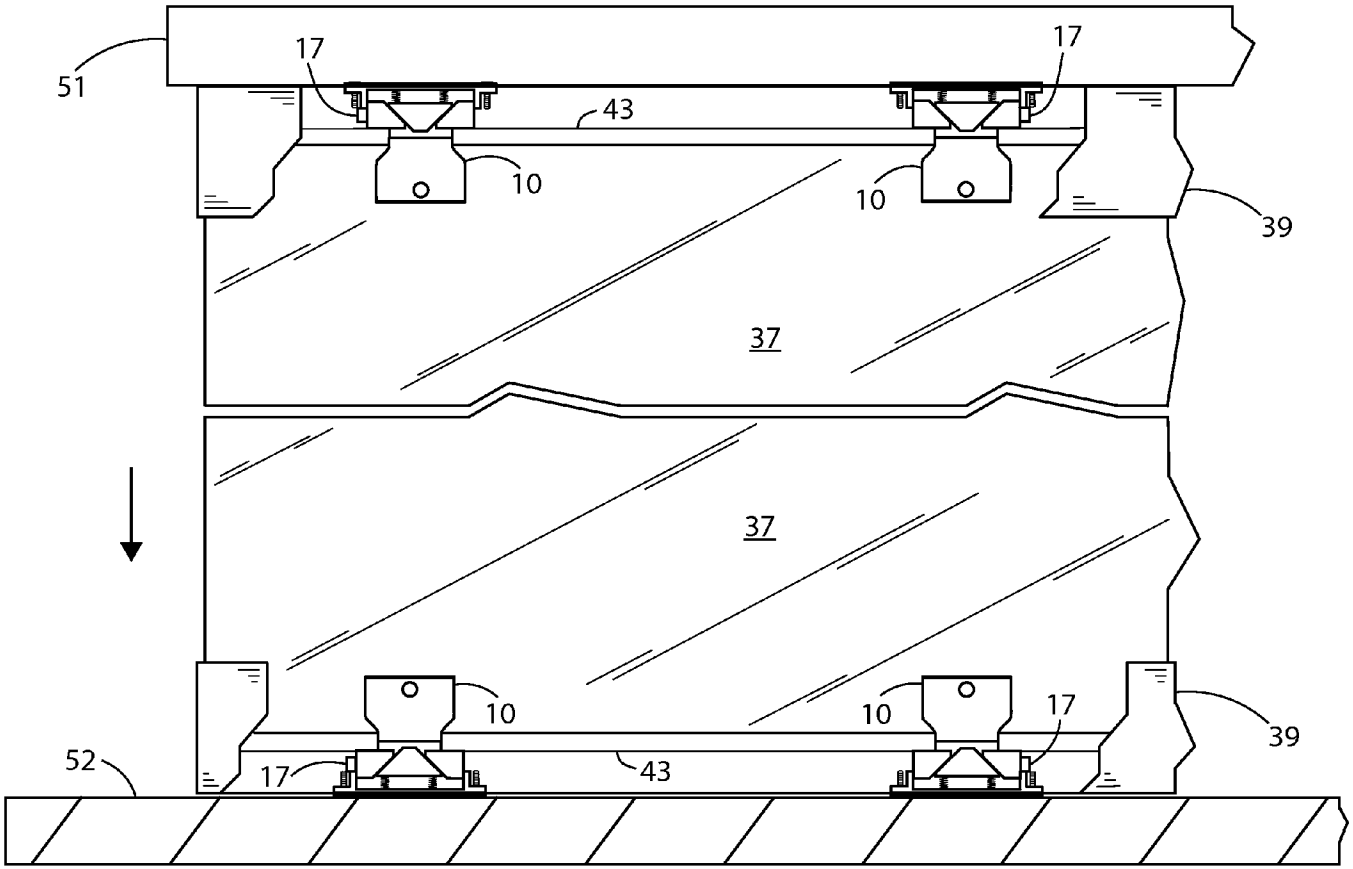
FIG. 11 illustrates in front elevation view, an in-fill panel and in-fill frame assembly with the device of FIG. 1 mounted on a trolley.
Figure 12:
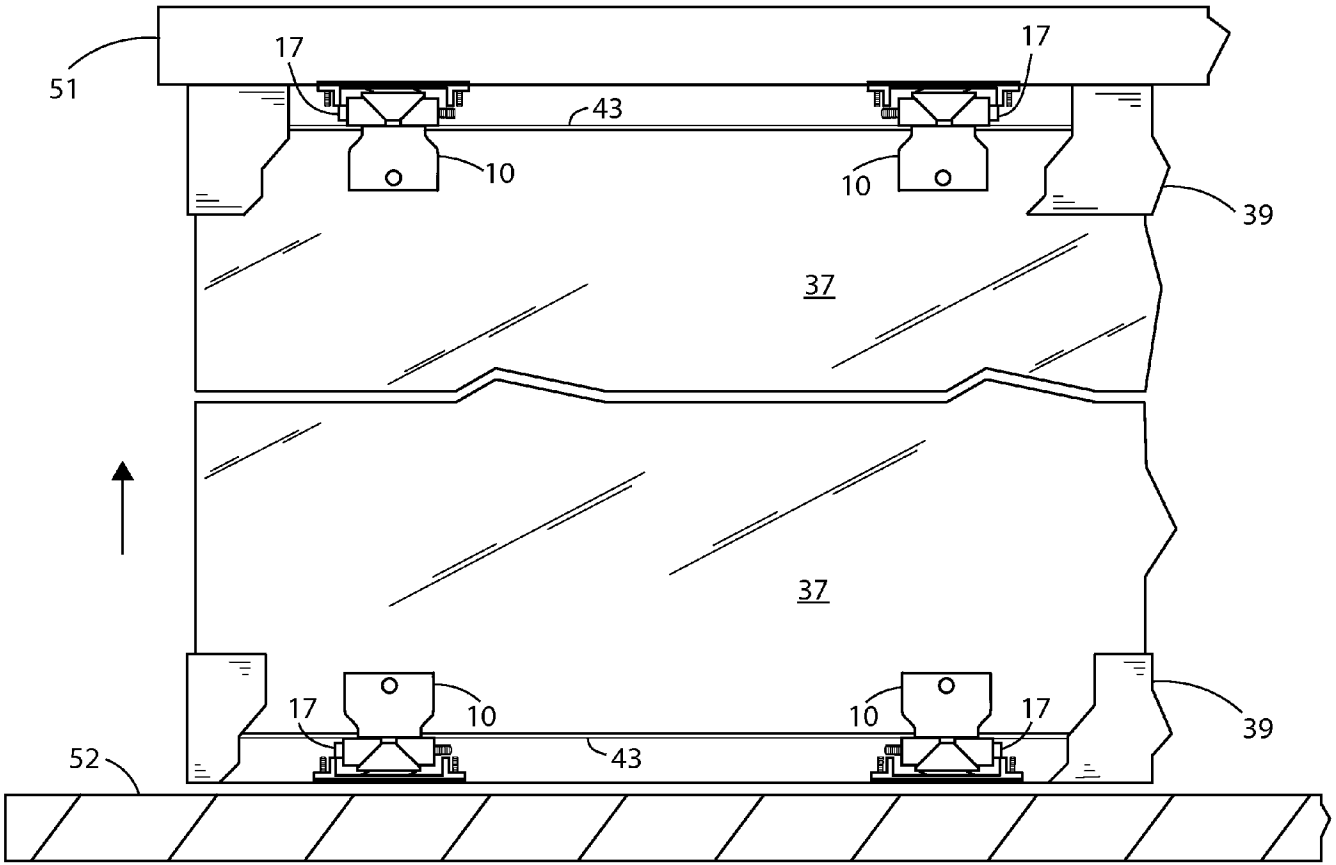
FIG. 12 illustrates the assembly of FIG. 11 with the device of FIG. 1 causing the in-fill panel to be adjusted to an alternative vertical position than FIG. 11.

FIG. 11 illustrates in front elevation view an in-fill panel 37 and panel frame 39 with the wall/door panel adjustment device 10 optionally mounted on a trolley inside the header 51. The trolley allows the in-fill panel 37 and panel frame 39 to slide horizontally. FIG. 12 illustrates the assembly of FIG. 11 with the wall/door panel adjustment device 10 causing the in-fill panel 37 to be adjusted to an alternative vertical position than FIG. 11. In FIGS. 11-12, the panel frame 39 is illustrated in partial cutaway view to expose the wall/door panel adjustment device 10. In FIG. 11 the threaded adjustment fastener 17 on the wall/door panel adjustment devices 10 are shown loosened so that the in-fill panel 37 is moved away from shelf portions 43 of the panel frame thereby moving the in-fill panel 37 downward toward the floor 52. In FIG. 12, the threaded adjustment fastener 17 on the wall/door panel adjustment devices 10 are shown tightened so that the in-fill panel 37 is moved toward the shelf portions 43 of the panel frame 39 thereby moving the in-fill panel 37 upward away from the floor 52. Adjusting the wall/door panel adjustment devices 10 illustrated in FIGS. 11-12 individually allow the in-fill panel 37 to be adjusted in place at a variety of angles and distances, in place with the need to disassemble or remove the in-fill panel 37 and panel frame 39 finished assemblies.

While four of the wall/door panel adjustment devices 10 are shown in FIGS. 11-12, as few as two of the wall/door panel adjustment devices 10 can be used to adjust the distance and the angle of the in-fill panel 37 with respect to the panel frame 39. For example, in FIGS. 11-12, the wall/door panel adjustment devices 10 nearest to the floor 52 could be removed and the two remaining of the wall/door panel adjustment devices 10 can readily adjust the vertical distance and the angle of the in-fill panel 37 relative to the panel frame 39.

Figure 13:
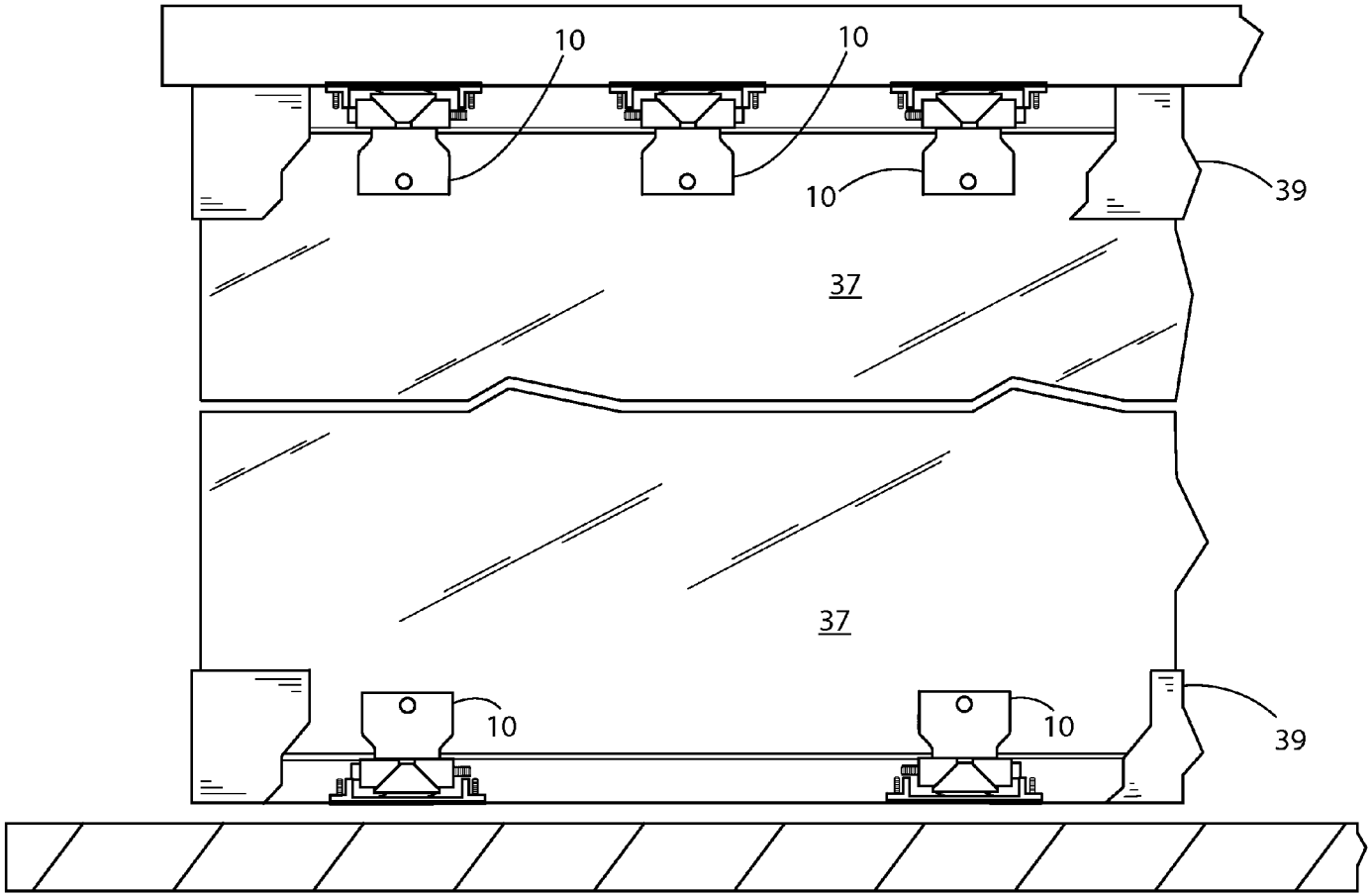
FIG. 13 illustrates in front elevation view, an in-fill panel and in-fill frame assembly with the device of FIG. 1 mounted on a trolley in the alternative.

It may be desirable to afford greater flexibility in adjusting the in-fill panel 37. FIG. 13 illustrates in front elevation view, an in-fill panel 37 and panel frame 39 with five of the wall/door panel adjustment device 10. The panel frames 39 are illustrated in partial cutaway view to expose the wall/door panel adjustment devices 10. The fifth of the wall/door panel adjustment devices 10 is shown positioned approximately at the center top of the in-fill panel 37 while the other four of the wall/door panel adjustment devices 10 are placed, as in FIGS. 11-12, near the top and bottom corners of the in-fill panel 37. In this configuration, center top of the wall/door panel adjustment devices 10 can be used to help set the vertical position of the in-fill panel 37 while the other of the wall/door panel adjustment devices 10 can be used to adjust the angle relation to the panel frame 39.

Figure 14:
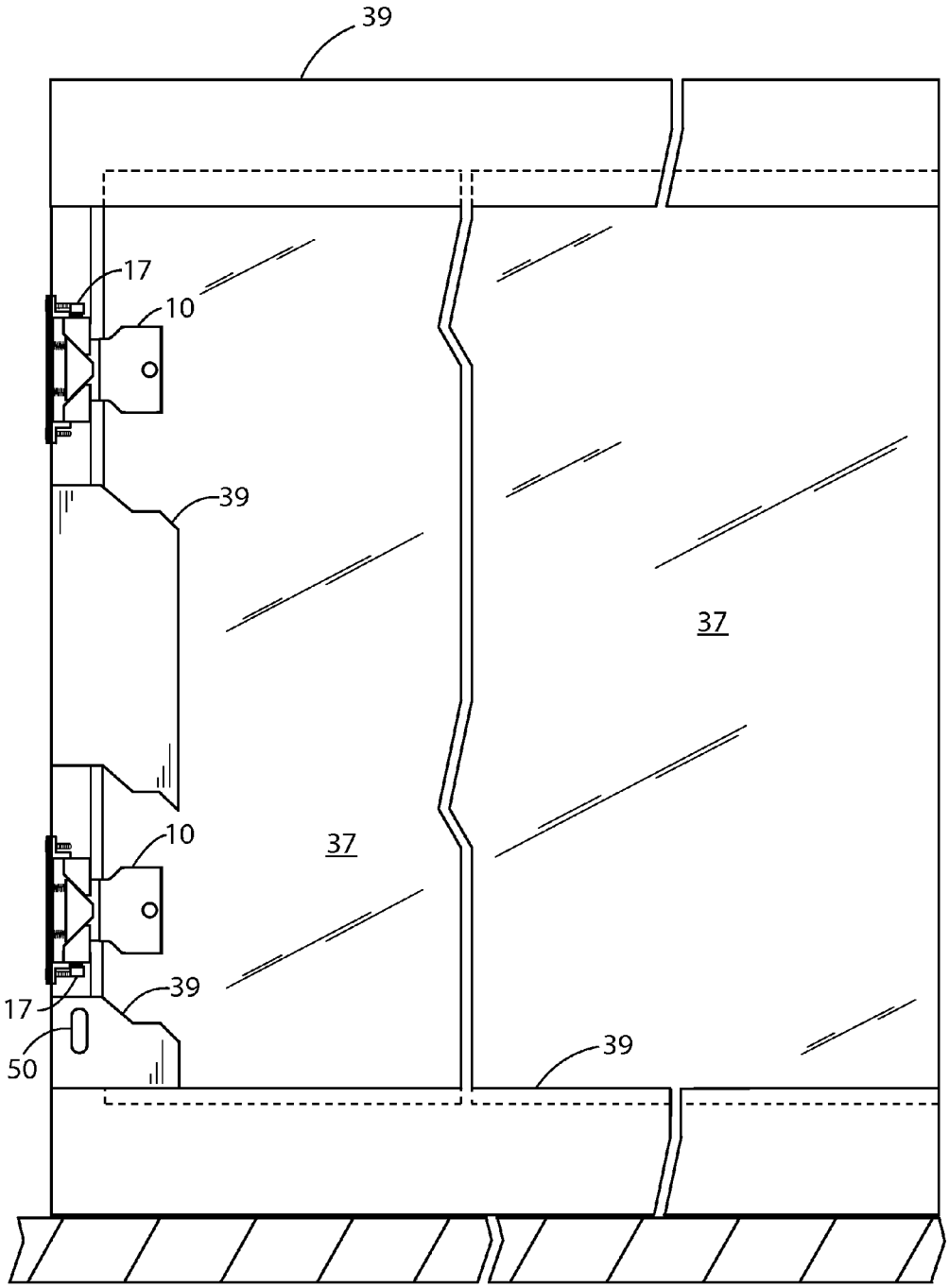
FIG. 14 illustrates in front elevation view, an in-fill panel and in-fill frame assembly with the device of FIG. 1 allowing for horizontal adjustment.

It may also be desirable to adjust the horizontal position and vertical angle of the in-fill panel 37 relative to the panel frame 39; for example, in a glass door panel. FIG. 14 illustrates in front elevation view, an in-fill panel 37 and a panel frame 39 assembly configured for horizontal position adjustment. In FIG. 14, the in-fill panel 37 is shown with both vertical and horizontal portions of the panel frame 39. The vertical portion of the panel frame 39 is illustrated in partial cutaway view to expose the wall/door panel adjustment device 10. Portions of the in-fill panel 37 are shown in broken lines indicating that they are hidden beneath the horizontal portions of the panel frame 39. The wall/door panel adjustment devices 10 are mounted within a vertical member of the panel frame 39. Tightening the threaded adjustment fasteners 17 moves the in-fill panel 37 closer to the left vertical member of the panel frame 39 while loosening the threaded adjustment fasteners 17 moves the in-fill panel 37 away from the vertical member of the panel frame 39. In FIG. 14, the threaded adjustment fasteners 17 can be accessed by an aperture 50, for example by a right angle hex head tool. The aperture 50 can be covered by a cover plate to create and ascetically pleasing appearance. The cover plate can be, for example, a snap-in cover made of plastic or metal. Those skilled in the art will readily recognize other materials appropriate for a cover plate for the aperture 50. While the aperture 50 is illustrated as a slotted aperture, it can be any shaped aperture suitable for receiving a tool capable of adjusting the threaded adjustment fastener 17. For example, the aperture 50 can also be a circular, rectangular, square, or oblong aperture.

Figure 15:
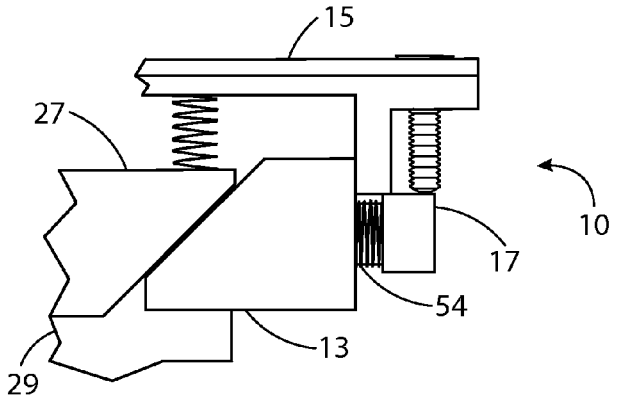
FIG. 15 illustrates a detail view of a portion of the wall/door panel adjustment device in the central position of FIG. 14 showing a spring used with the threaded adjustment fastener.

In FIG. 13, over tightening of the center top of the wall/door panel adjustment devices 10 can cause stress on the in-fill panel 37. This can be of particular concern if the in-fill panel 37 is made of glass or another fragile or brittle material. One solution is shown in FIG. 15, which is a detailed view of a portion the wall/door panel adjustment device 10 positioned in the center top of FIG. 13. FIG. 15 shows portions of the threaded adjustment fastener, the block keeper 15, the wedge-like portion 27, and the angled pockets 29, as well as one of the angled adjustment blocks 13. In FIG. 15, a spring 54 surrounds the threaded adjustment fastener 17 to prevent over tightening. The spring 54 is positioned between the angled adjustment block 13 and the head of the threaded adjustment fastener 17.

Figure 16:
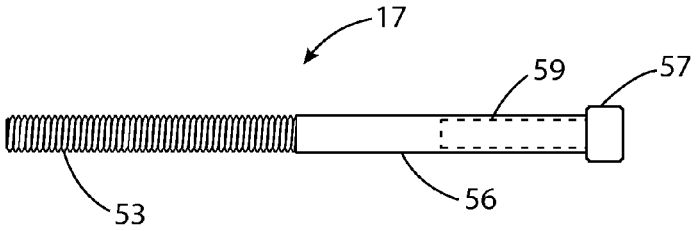
FIG. 16 illustrates the device adjusting threaded fastener.
Figure 17:
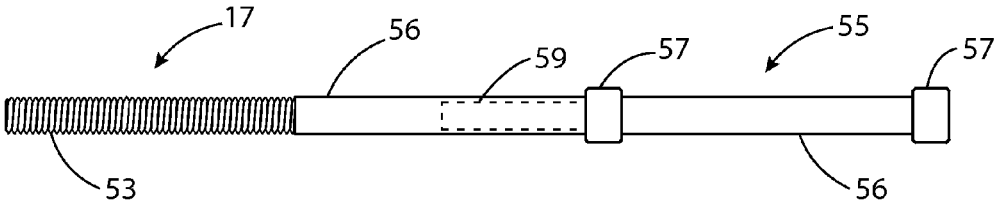
FIG. 17 illustrates an alternative version of the device adjusting threaded fastener.

The wall/door panel adjustment devices 10 illustrated throughout this disclosure are adjusted by a threaded adjustment fastener 17 that is hidden within the panel frame 39 of FIGS. 7-15. The threaded adjustment fastener 17 can typically be accessed by removing an end cap on either end of the panel frame 39. FIG. 16 illustrates a typical version of the threaded adjustment fastener 17 that can be used for this purpose. The threaded fastener can be a screw, bolt, or similar threaded fastening device. FIG. 17 shows a way of extending the length of the threaded adjustment fastener 17 by screwing into it into a similarly constructed threaded adjustment fastener 55 to afford the possibly of easier access for the installer. Additional similarly constructed threaded adjustment fasteners 55 can be added to further extend the length as desired. Alternatively, instead of screwing the threaded adjustment fasteners 17 and the similarly constructed threaded adjustment fastener 55 together, the similarly constructed threaded adjustment fastener 55 and threaded adjustment fastener 17 can manufactured as a single unit.

The threaded adjustment fastener 17 of FIGS. 16-17 is configured with a externally threaded portion 53, a hollow portion 56, and a fastener head 57. The hollow portion 56 is wider than the externally threaded portion 53 and includes a hollow threaded interior 59 to receive and secure a similar externally threaded portion from the similarly constructed threaded adjustment fastener 55 of FIG. 17. The fastener head 57 must be able to accommodate both the similarly constructed threaded adjustment fasteners 55 and the head of a tool for rotating the threaded adjustment fastener 17. This can be accomplished by shaping the head of the threaded adjustment fastener 17 to receive a tool head; for example, the head can be shaped hexagonally and sized to receive a standard socket wrench or nut driver. This can alternatively be accomplished by shaping the hollow interior of the fastener head 57 to receive a tool that only requires interior perimeter engagement, for example a hex or Allen head shaped fastener head. Other interior perimeter engaging tool heads can readily be used; for example a square or Robertson head.

A device for adjusting wall and door panels has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A device for adjusting an in-fill panel with respect to a panel frame, comprising:

an in-fill attachment secured to the in-fill panel, the in-fill attachment includes an in-fill receiving portion, a wedge-shaped portion integral to a side of the in-fill attachment, and inset dual angled pockets, the inset dual angled pockets are inset from the side of the in-fill attachment and bound by opposing converging sides of the wedge-shaped portion and by an inward edge of the in-fill receiving portion;

angled adjustment blocks;

a threaded adjustment fastener secures the angled adjustment blocks on opposing faces of the inset dual angled pockets;

the angled adjustment blocks each include an exterior edge angled to move the angled adjustment blocks along the opposing converging sides when the threaded adjustment fastener is adjusted; and the angled adjustment blocks positioned in relation to the wedge-shaped portion so that tightening the threaded fastener moves the angled adjustment blocks along the wedge-shaped portion toward each other and toward the inward edge of the in-fill receiving portion.

2. The device of claim 1 further comprising:

a block keeper secured to the panel frame; and the block keeper includes portions on opposing ends projecting into the panel frame and positioned to restrict movement of the angled adjustment blocks outward from the in-fill attachment.

3. The device of claim 2 further comprising a spring positioned between the in-fill attachment and the block keeper.

4. The device of claim 3 further comprising:

the panel frame including a cutout sized and shaped to constrain movement of the in-fill attachment in the direction normal to a length of the panel frame.

5. A device for adjusting an in-fill panel with respect to a panel frame, comprising:

an in-fill attachment secured to the in-fill panel and movable with one degree of freedom in a direction normal to a length of the panel frame;

inset dual angled pockets that are integral to the in-fill attachment;

a threaded adjustment fastener; and angled adjustment blocks, constrained within the panel frame, and with apertures for receiving the threaded adjustment fastener therethrough;

the angled adjustment blocks are positioned on opposing sides of the inset dual angled pockets and constrained to move along the sides of the inset dual angled pockets by the adjusting the threaded adjustment fastener thereby moving the in-fill panel;

a block keeper secured to the panel frame;

the block keeper includes portions on opposing ends projecting into the panel frame and positioned to restrict movement of the angled adjustment blocks outward from the in-fill attachment; and a spring positioned between the in-fill attachment and the block keeper.

6. The device of claim 5 further comprising:

the panel frame including a cutout sized and shaped to constrain movement of the in-fill attachment in the direction normal to the length of the panel frame.

7. A device for adjusting an in-fill panel with respect to a panel frame, comprising:

an in-fill attachment secured to the in-fill panel, the in-fill attachment includes an in-fill receiving portion, a wedge-like portion, and inset dual angled pockets, the inset dual angled pockets bound by opposing angled inward facing sides of the wedge-like portion and by an inward edge of the in-fill receiving portion;

angled adjustment blocks;

a threaded adjustment fastener secures the angled adjustment blocks on opposing faces of the inset dual angled pockets;

the angled adjustment blocks include an exterior edge angled and an interior sized to move the angled adjustment blocks along the inset dual angled pockets when the threaded adjustment fastener is adjusted;

a block keeper secured to the panel frame;

the block keeper includes portions on opposing ends projecting into the panel frame and positioned to restrict movement of the angled adjustment blocks outward from the in-fill attachment; and a spring positioned between the in-fill attachment and the block keeper.

8. The device of claim 7 further comprising:

the panel frame including a cutout sized and shaped to constrain movement of the in-fill attachment in the direction normal to a length of the panel frame.

* * * * *